US011543206B1

(12) United States Patent
Rucci

(10) Patent No.: US 11,543,206 B1
(45) Date of Patent: Jan. 3, 2023

(54) SHOOTING REST WITH SHOULDER REST

(71) Applicant: Good Sportsman Marketing, LLC, Irving, TX (US)

(72) Inventor: Thomas Rucci, Henderson, NV (US)

(73) Assignee: Good Sportsman Marketing, LLC, Irving, TX (US)

( * ) Notice: Subject to any disclaimer, the term of this patent is extended or adjusted under 35 U.S.C. 154(b) by 0 days.

(21) Appl. No.: 17/352,196

(22) Filed: Jun. 18, 2021

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/12; F41A 23/02; F41A 23/14
USPC ..... 42/94
See application file for complete search history.

(56) References Cited

U.S. PATENT DOCUMENTS 4,621,563 A * 11/1986 Poiencot ..... F41A 23/16 73/167
4,799,324 A * 1/1989 Nodo ..... F41A 23/16 42/94
5,070,636 A * 12/1991 Mueller ..... F41A 23/16 73/167
5,081,783 A * 1/1992 Jarvis ..... F41A 23/16 42/94
5,791,499 A * 8/1998 Zebbedies ..... B60R 7/14 248/176.1
6,058,641 A 5/2000 Vecqueray
D521,100 S 5/2006 Morrow
D553,219 S 10/2007 Potterfield
D576,245 S 9/2008 Potterfield
7,584,690 B2 9/2009 Cauley
7,774,972 B2 8/2010 Potterfield
7,779,572 B2 8/2010 Potterfield
7,823,317 B2 11/2010 Potterfield
7,845,267 B2 12/2010 Potterfield
7,946,071 B2 5/2011 Cauley
7,954,272 B2 6/2011 Potterfield
7,997,021 B2 8/2011 Cauley
8,011,129 B2 * 9/2011 Cauley ..... F41A 23/16 D22/108
8,096,077 B1 * 1/2012 Caywood ..... F41A 23/005 73/167
8,104,212 B2 1/2012 Potterfield
8,109,028 B2 * 2/2012 Roberts ..... F41A 25/04 89/37.04
8,132,351 B2 3/2012 Potterfield
8,296,988 B2 10/2012 Yale
8,316,570 B2 11/2012 Potterfield
8,327,570 B2 12/2012 Potterfield
8,356,442 B2 1/2013 Potterfield
8,393,106 B2 3/2013 Cauley
8,464,628 B2 6/2013 Potterfield
8,516,734 B2 8/2013 Yale
(Continued)

*Primary Examiner* — Joshua E Freeman
(74) *Attorney, Agent, or Firm* — Lightbulb IP, LLC

(57) ABSTRACT

A shooting rest with a shoulder rest supports a rear end of a firearm at the shoulder rest and a front end of the firearm at a firearm support. The shoulder rest and firearm support are mounted, respectfully, at a first and second ends of the shooting rest's frame. The shoulder rest comprises a recess for receiving the firearm and receives and encapsulates one or more mounts in a body thereof. A pad for engaging a user's shoulder extends outward opposite the recess.

10 Claims, 4 Drawing Sheets

(56) References Cited

U.S. PATENT DOCUMENTS

| | | | | |
|---|---|---|---|---|
| 8,578,645 | B2 | 11/2013 | Cauley | |
| 8,621,773 | B2 * | 1/2014 | Morrow | F41A 23/16 42/94 |
| 8,745,913 | B2 | 6/2014 | Hicks | |
| 8,931,193 | B1 * | 1/2015 | Bogart | F41A 23/16 42/1.06 |
| 8,931,201 | B2 | 1/2015 | Gianladis | |
| 9,140,512 | B2 * | 9/2015 | Witchel | F41A 25/00 |
| 9,151,561 | B2 | 10/2015 | Morrow | |
| 9,618,291 | B1 * | 4/2017 | Henderson | F41A 23/02 |
| 9,702,653 | B2 * | 7/2017 | Cauley, Jr. | F41A 23/02 |
| 10,317,162 | B2 | 6/2019 | Morrow | |
| 10,365,069 | B1 | 7/2019 | Tayon | |
| 10,514,225 | B2 | 12/2019 | Cauley | |
| 10,782,085 | B2 * | 9/2020 | Cauley, Jr. | F41A 23/16 |
| 2005/0000141 | A1 * | 1/2005 | Cauley | F41A 23/16 42/94 |
| 2007/0256346 | A1 | 11/2007 | Potterfield | |
| 2008/0047188 | A1 | 2/2008 | Lindstrom | |
| 2008/0134555 | A1 * | 6/2008 | Werner | F41A 23/16 42/69.01 |
| 2008/0168697 | A1 | 7/2008 | Potterfield | |
| 2008/0263928 | A1 | 10/2008 | Potterfield | |
| 2010/0126055 | A1 | 5/2010 | Potterfield | |
| 2011/0197748 | A1 * | 8/2011 | Roberts | F41A 23/16 89/43.01 |
| 2012/0186125 | A1 * | 7/2012 | Werner | F41A 23/18 42/94 |
| 2014/0202057 | A1 * | 7/2014 | Witchel | F41A 25/00 42/1.06 |
| 2017/0102203 | A1 * | 4/2017 | Cauley, Jr. | F41A 23/02 |
| 2019/0271522 | A1 | 9/2019 | Nousiainen | |
| 2020/0033089 | A1 | 1/2020 | Morrow | |
| 2020/0208933 | A1 | 7/2020 | Wynalda | |
| 2021/0041202 | A1 * | 2/2021 | Cauley, Jr. | F41A 23/12 |

* cited by examiner

SHOOTING REST WITH SHOULDER REST

BACKGROUND OF THE INVENTION

1. Field of the Invention

The invention relates to supports for firearms and in particular to a shooting rest with a shoulder rest.

2. Related Art

Shooting rests are often used to "sight in" various firearms. In general, a shooting rest holds a firearm in position so that the firearm can be fired in a consistent manner, allowing a user to adjust the firearm's sights.

From the discussion that follows, it will become apparent that the present invention addresses the deficiencies associated with the prior art while providing numerous additional advantages and benefits not contemplated or possible with prior art constructions.

SUMMARY OF THE INVENTION

A shooting rest with a shoulder rest is disclosed herein. The shooting rest supports and secures a firearm in position, which aids in firing the firearm as well as facilitating testing, maintenance, and repair. As will be described further below, the shoulder rest provides a structure that a user can engage and that supports a portion of the firearm.

Various embodiments of the shooting rest are disclosed herein. For instance, in one exemplary embodiment, a shooting rest comprises a frame having a first end and a second end, a firearm support at the second end, and one or more mounts at the first end, the mounts extending upward.

A shoulder rest is at the first end and comprises a body comprising one or more cavities between a front end, a rear end, and sides of the body, and a recess comprising an open portion for receiving a portion of a firearm. The mounts extend into the cavities, and the open portion is defined by a back wall at the front end of the body, one or more side walls, and a bottom, the open portion being open in a direction facing the firearm support. One or more pads extend outward at a rear end of the body as well.

An open webbing portion may be proximal to the pads, the back wall, or both. In addition, one or more spines may be proximal to the back wall. The mounts may be formed from a rigid material while the shoulder rest is formed from a resilient material that is less rigid than the rigid material.

In another exemplary embodiment, a shooting rest comprises a frame having a first end and a second end, a firearm support at the second end, and one or more mounts at the first end, the mounts extending upward.

A shoulder rest is at the first end and comprises a body comprising one or more cavities between a front end, a rear end, and sides of the body. The mounts extend into the cavities. The shoulder rest also includes an open portion at the front end for receiving a portion of a firearm. The open portion is defined by a back wall at the front end of the body, one or more side walls, and a bottom, the side walls and the bottom extending outward from the back wall and the open portion being open in a direction facing the firearm support.

One or more pads may extend outward at a rear end of the body. In addition, an open webbing portion may be proximal to the pads, the back wall, or both. One or more spines may be proximal to the back wall. Similar to above, the mounts may be formed from a rigid material while the shoulder rest is formed from a resilient material that is less rigid than the rigid material.

Various methods are disclosed herein as well. For instance, in one exemplary embodiment, a method for providing a shooting rest is provided, with such method comprising forming one or more cavities in a body between a front end, a rear end, and sides of the body, and forming an open area at the front end of the body. The open area is defined by a back wall at the front end of the body, one or more side walls, and a bottom, the side walls and the bottom extending outward from the back wall.

One or more mounts are received in the cavities, with the mounts being attached to a frame of the shooting rest at a first end of the frame. A firearm support is attached at a second end of the frame. The open portion of the shoulder rest is open in a direction facing the firearm support. In operation, a first portion of a firearm is received at the open portion and a second portion of the firearm is received at the firearm support.

One or more pads may be formed at the rear end of the body. The pads may extend outward at a rear end of the body. In addition, an open webbing portion may be formed in the body proximal to the pads, the back wall, or both.

Similar to above, one or more spines may be formed in the body proximal to the back wall. The mounts and the frame may be formed from a rigid material and the body is formed from a resilient material that is less rigid than the rigid material.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
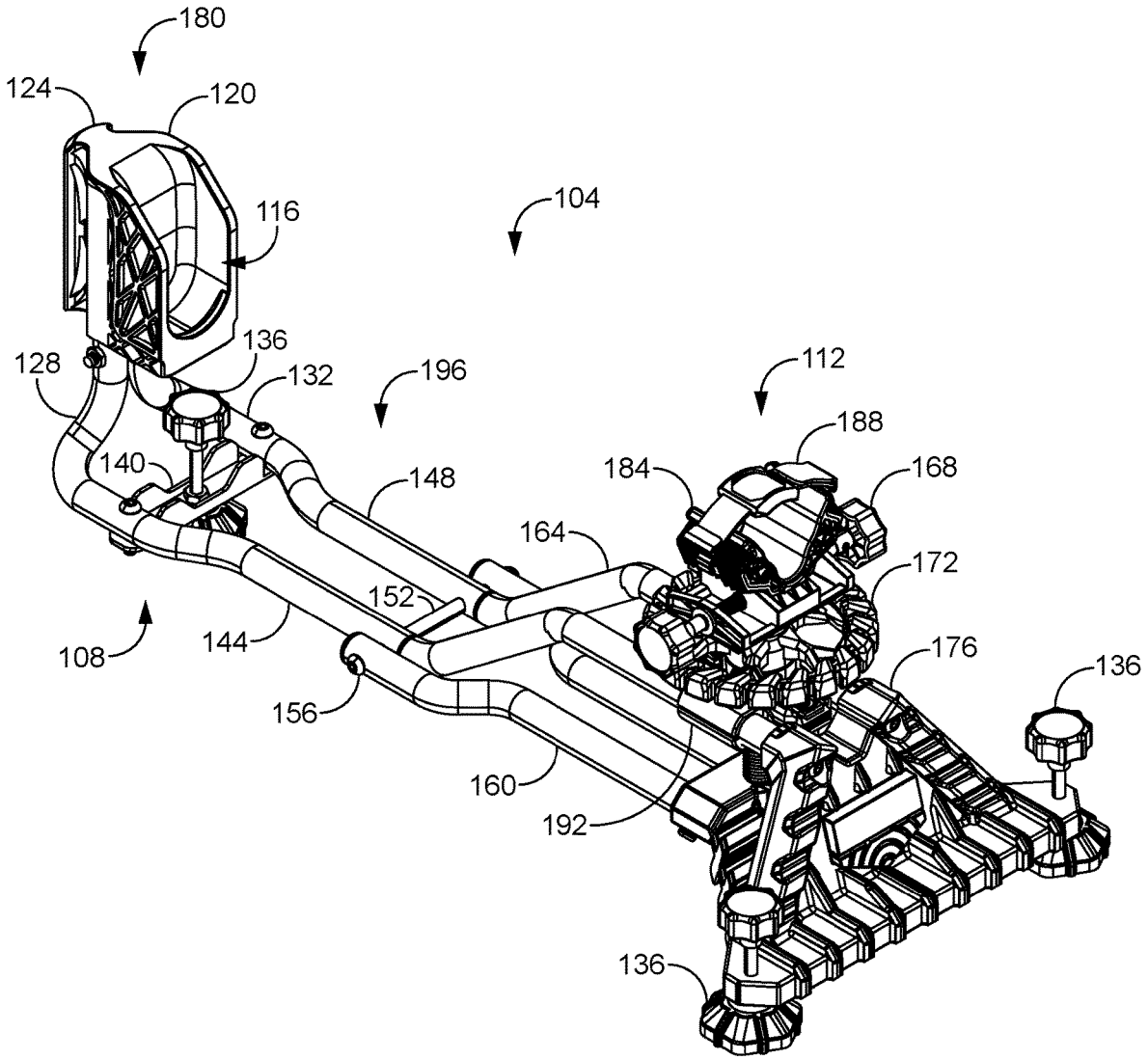
FIG. 1 is a perspective view of an exemplary shooting rest with a shoulder rest.

As can be seen from FIG. 1, a shooting rest 104 having a shoulder rest 180 is disclosed herein. The shooting rest 104 will typically comprise a rear end 108 and a front end 112 that respectively support a first and second end of a firearm. For example, the rear end 108 may support a butt end of a rifle, while the front end 112 may support a forestock or barrel end of the rifle.

A frame 196 will typically extend between the rear end 108 and the front end 112 of a shooting rest 104. A frame 196 may comprise individual sections, such as a back section and a front section. A frame 196 may be formed from one or more frame members. As shown in FIG. 1 for example, the back section comprises frame members 144, 148, while the front section comprises frame members 160, 164. The back section of a frame will typically also include one or more mounts 128, 132.

It is contemplated that sections of a frame 196 may be movable or removable, such as to facilitate storage or transport. For example, one or more removable fasteners 156, one or more pivots 152, or both may connect sections of a frame. This allows a frame 196 to have removable or rotatable sections that are movable relative to one another.

A frame 196 will typically be provided to support various components of a shooting rest 104. For example, a shoulder rest 180, firearm support 184, structural ballast 176, one or more feet 136, or various subsets thereof may be supported by a frame. To illustrate, as shown in the embodiment of FIG. 1, a shoulder rest 180 may be attached to one or more mounts 128, 132, a firearm support 184 may be attached to one or more frame members 164, and a structural ballast 176 may be attached to one or more frame members 160, 164.

One or more crossmembers 140 may be provided as well, such as to strengthen, stiffen, or otherwise reinforce a frame 196. A crossmember 140 may form a mount for various elements of a shooting rest 104 as well. For example, one or more feet 136 or other elements may be mounted to a crossmember 140.

In operation, a firearm will typically be held at a shoulder rest 180 and a firearm support 184. For example, a first portion of a firearm may be received at a shoulder rest 180, namely at a recess 116 formed in a body 120 thereof, while a second portion of the firearm is received at a firearm support 184. As will be described further below, a user may engage a pad 124 at a rear end of the shoulder rest 180, such as with the user's shoulder to operate and fire the firearm.

A firearm support 184 may be movably mounted, such as to allow adjustments for windage, elevation, and the length of a firearm. As can be seen in FIG. 1, a firearm support 184 may comprise a windage adjustment 168 to make lateral adjustments, an elevation adjustment 172 to make elevation changes, and a sliding carriage 192 to accommodate firearms of various lengths. The firearm support 184 may also include one or more clamping mechanisms 188 to secure a firearm thereto. As can be seen, the clamping mechanism in FIG. 1 is a strap.

Figure 2:
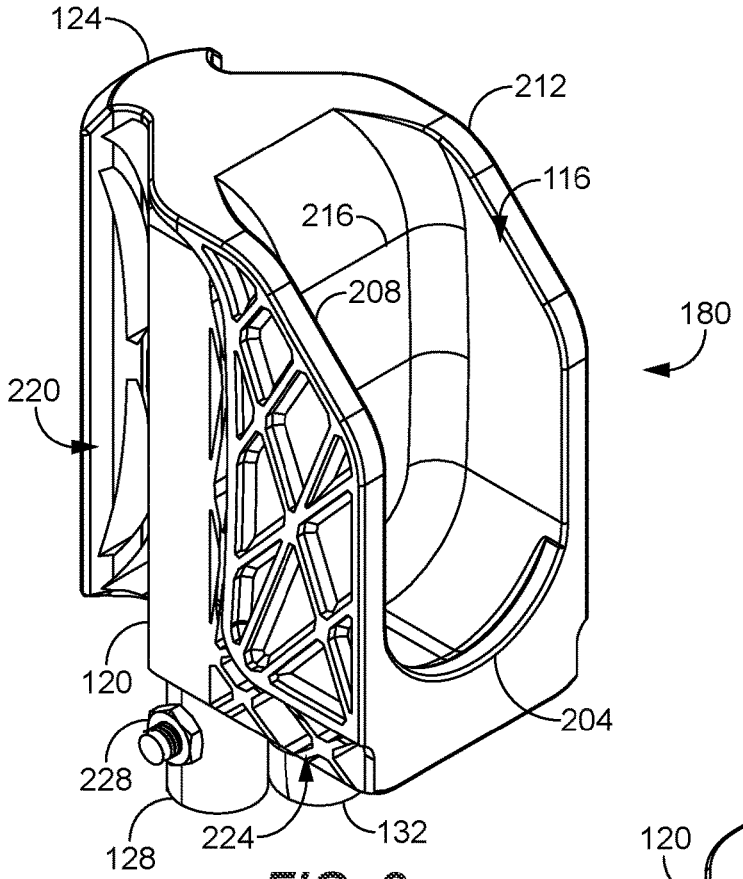
FIG. 2 is a front perspective view of an exemplary shoulder rest.
Figure 3:
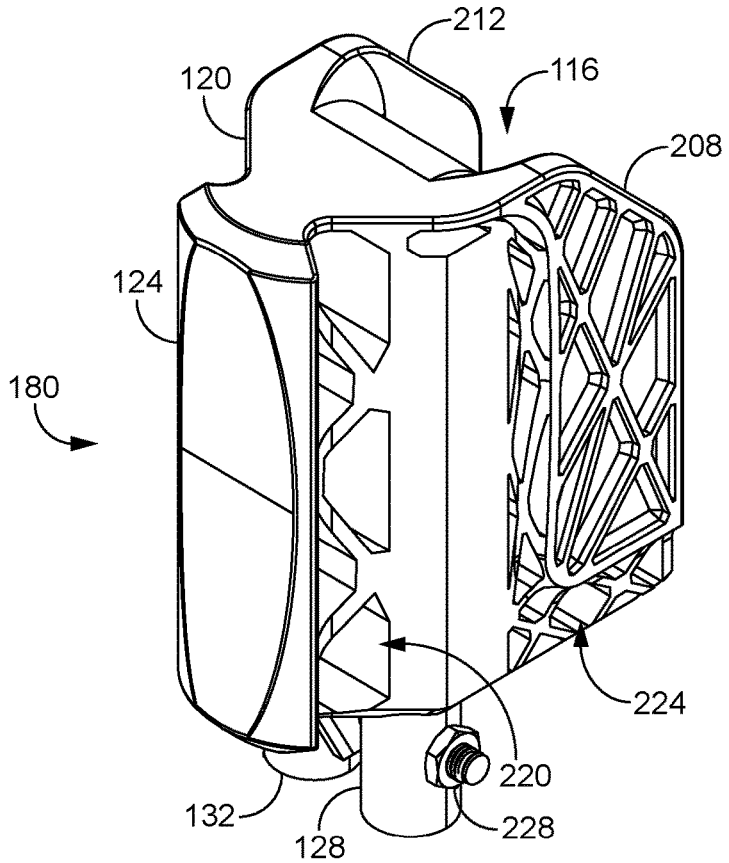
FIG. 3 is a back perspective view of an exemplary shoulder rest.

A shoulder rest 180 may comprise one or more recesses 116 that receive a portion of a firearm, such as a butt end of a firearm. As can be seen in FIGS. 2 and 3, which respectively illustrate a front and rear perspective view of a shoulder rest 180, a recess 116 may be a socket, cavity, or other open portion formed at a front end of a body 120 of a shoulder rest. A recess 116 may comprise a bottom 204, one or more walls 208, 212, 216, or both. As shown in FIG. 1 for example, the recess 116 comprises a bottom 204, laterally spaced apart side walls 208, 212 and a back wall 216.

One or more side walls 208, 212 may be provided to prevent lateral movement of a firearm when received a recess 116. A back wall 216 may be provided to prevent axial movement of a firearm, such as when the firearm is fired. A bottom 204 may be provided to support a firearm at an elevated position by providing a platform upon which a portion of the firearm may rest.

One or more pads 124 may be at a rear end of a shoulder rest 180. As described above, a pad 124 may be engaged by a user, such as by a user's shoulder, to operate a firearm. In one or more embodiments, a pad may absorb recoil from firing a firearm, thereby reducing the recoil transferred to a user.

A pad 124 may comprise a collapsible or otherwise resilient portion. As can be seen from FIGS. 2 and 3 for example, the pad 124 comprises an open webbing 220 that can collapse to absorb energy when a firearm is fired and subsequently return to its original shape. It is contemplated that other portions of a recess 116 may be formed from a collapsible or otherwise resilient material as well. As can be seen for example, a back wall 216, bottom 204, or both may comprise an open webbing 224 structure.

Figure 4:
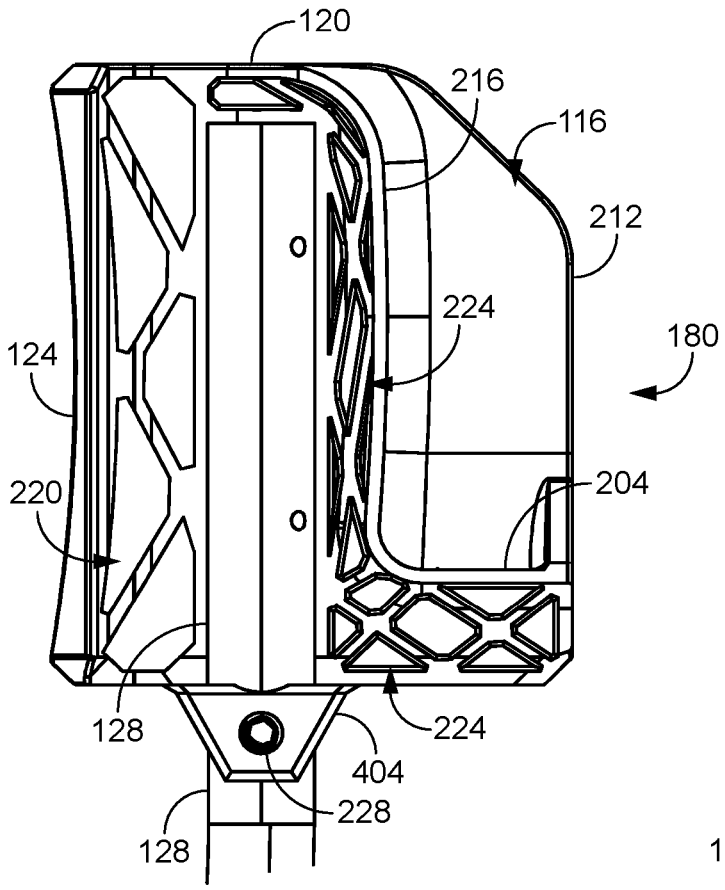
FIG. 4 is a side cross-sectional view of an exemplary shoulder rest.
Figure 5:
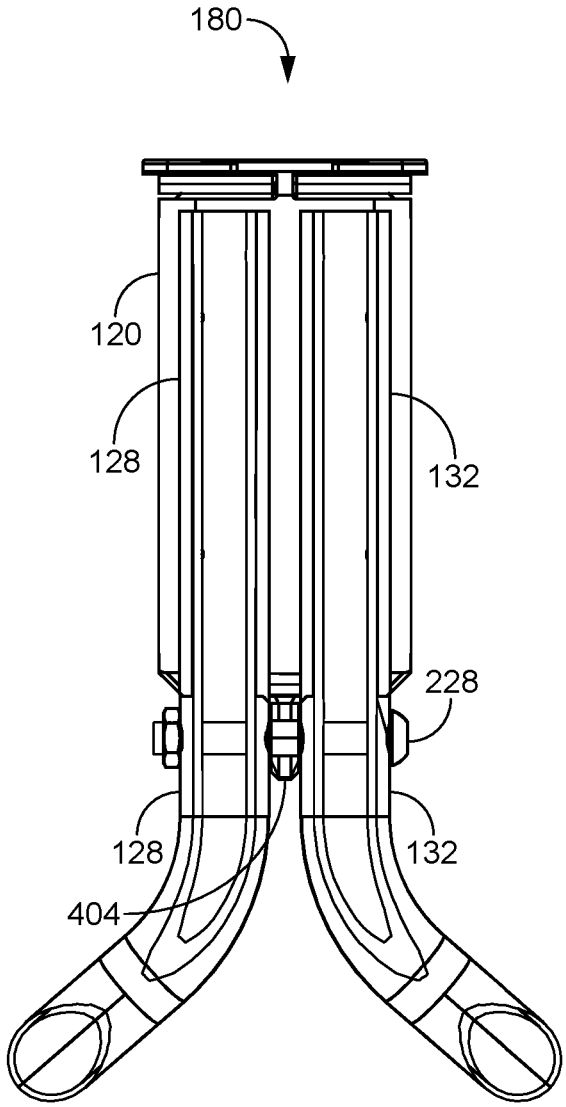
FIG. 5 is a front cross-sectional view of an exemplary shoulder rest.

As stated, one or more mounts 128, 132 may secure a shoulder rest 180 to the shooting rest 104. A mount 128, 132 may secure a shoulder rest 180 at the body 120 of the shoulder rest. Referring to FIGS. 4 and 5, which respectively illustrate side and front cross-sectional views of an exemplary shoulder rest 180, it can be seen that a body 120 may receive one or more mounts 128, 132 in a cavity thereof to mount a shoulder rest. In one or more embodiments, a body 120 encapsulates the periphery of one or more mounts 128, 132 received therein between the sides and front and rear ends of the body.

In some embodiments, a shoulder rest 180 may be secured to one or more mounts 128, 132 by one or more fasteners 228. As shown in FIGS. 4 and 5 the fastener 228 applies a force upon a tab 404 of the shoulder rest 180 to secure the shoulder rest. It is contemplated that the securing mechanism, such as a fastener 228, may be removed to allow a shoulder rest 180 to be removed for replacement, repair, or other purposes. For example, a shoulder rest 180 may be disengaged from its mounts 128, 132 during removal.

It can be seen in the side cross-sectional view of FIG. 4, that one or more mounts 128, 132 are received at the body 120 between the recess 116, at the front end of the shoulder rest, and the pad 124, at the rear end of the shoulder rest. In this manner, a firearm engages a front end of a shoulder rest 180 while a user engages a rear end of the shoulder rest, with the pad 124 extending outward to allow for user engagement.

As can be seen, recoil energy is absorbed by a back wall 216 of a recess 116 as well as one or more mounts 128, 136 before being transferred to one or more pads 124 and subsequently to a user's shoulder when a firearm is fired. The recoil energy also travels around one or more mounts 128, 132 because the body 120 encapsulates the one or more mounts. The energy is absorbed or otherwise dissipated as it travels through the shoulder rest 180 thereby reducing the effect of the recoil.

Figure 6:
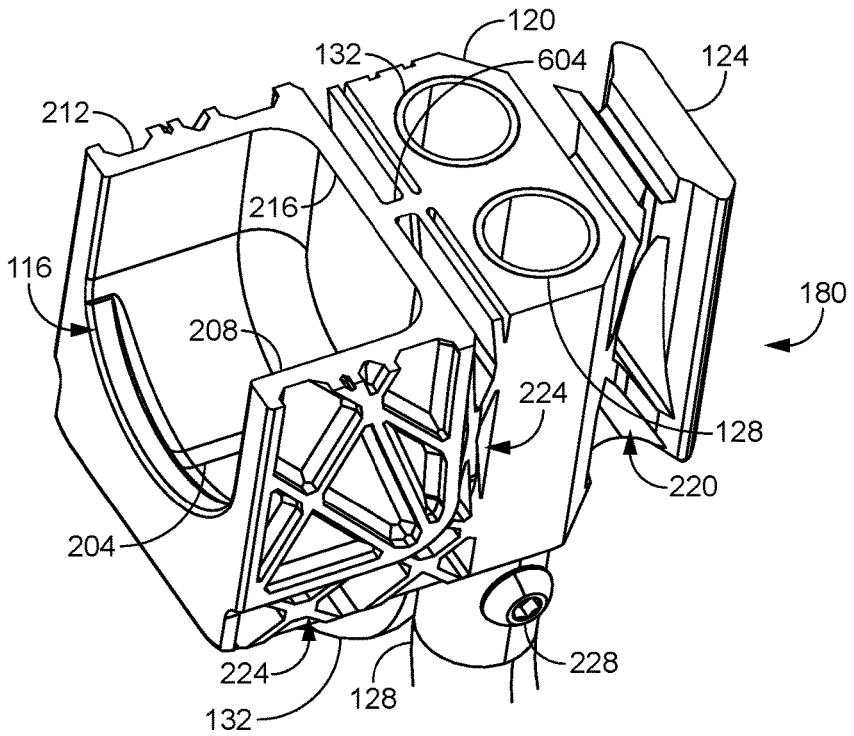
FIG. 6 is a perspective cross sectional view of an exemplary shoulder rest.

FIG. 6 provides a top perspective cross-sectional view of an exemplary shoulder rest 180. As can be seen, a body 120 will typically encapsulate, but not extend into the one or more mounts 128, 132, even where the one or more mounts are hollow, such as shown. In addition, it can be seen that one or more spines 604 may extend vertically at a back wall 216 of the shoulder rest 180. A spine 604 may be provided to reinforce an open web 224 at a back wall 216.

A shoulder rest 180, including its one or more recesses 116, pads 124, and the elements thereof will typically be formed from a single material, which may be a resilient material. Some exemplary resilient materials include natural or synthetic rubber, silicone, foam, and similarly resilient materials capable of being compressed or stretched and subsequently returning to their previous shape. Various structures may be formed in the material, such as to alter the resiliency of various portions of a shoulder rest 180. As described above for example, a shoulder rest 180 may comprise open webbing 120, 124, one or more spines 604, as well as other shaped openings for such purposes. In contrast, a frame and one or more mounts 128, 132 will typically be formed of a rigid material, having a distinctly higher rigidity than the resilient material of a shoulder rest 180.

Figure 7:
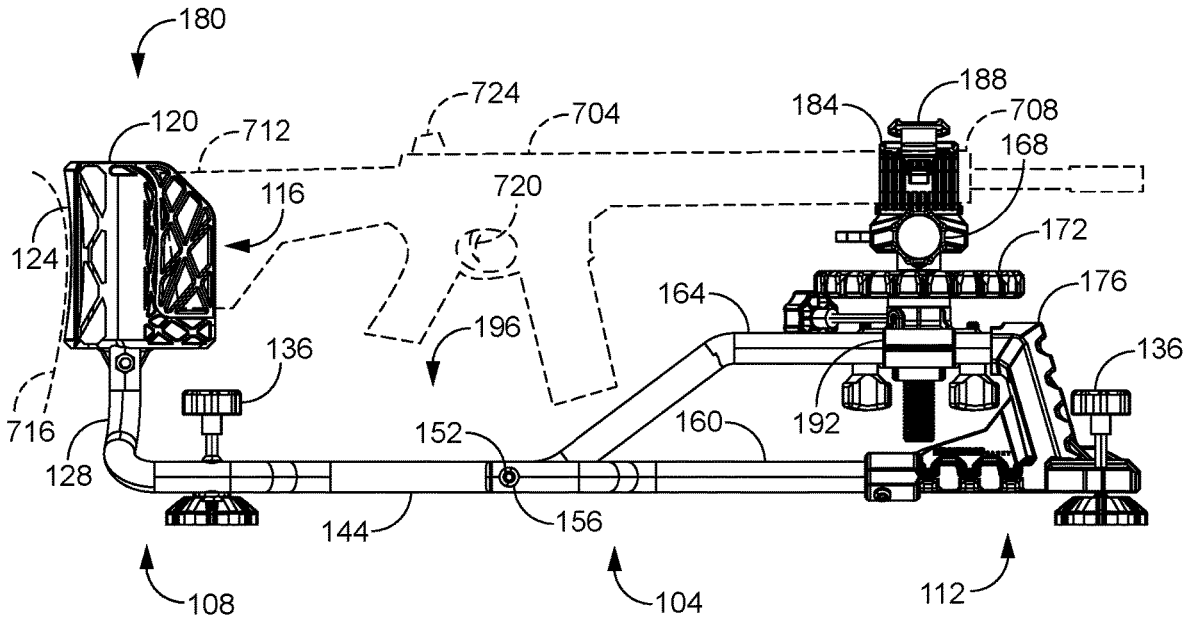
FIG. 7 illustrates an exemplary shooting rest with a shoulder rest in an environment of use.

FIG. 7 illustrates a side view of an exemplary shooting rest 104 in use. As shown, the shooting rest 104 is supporting a firearm 704, in this case a rifle. A first end 708 of the firearm 704 is supported by a firearm support 184 while a second end 712 of the firearm 704 is supported by a shoulder rest 180. More specifically, the second end 712 of the firearm 704 is held within the recess 116 of the shoulder rest.

As can also be seen, a user may engage a pad 124 of a shoulder rest 180 with their shoulder 716. The user directly engages the shoulder rest 180 at its pad 124, without the need for any intervening structures. In this position, the trigger 720, sight 724, and other portions of the firearm 704 are within arm's reach. The user can aim, fire, and adjust the firearm 704 as well while the firearm is secured in position by the shooting rest 104.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A shooting rest comprising:
a frame having a first end and a second end;
a firearm support at the second end;
one or more mounts at the first end; and
a shoulder rest at the first end, the shoulder rest comprising:
a body comprising one or more cavities between a front end, a rear end, and sides of the body, wherein the one or more mounts extend into the one or more cavities;
an open portion for receiving a portion of a firearm, the open portion defined by a back wall, one or more side walls, and a bottom, the open portion being open in a direction facing the firearm support;
one or more pads extending outward at the rear end of the body; and
an open webbing portion having one or more lateral openings, the open webbing portion between the back wall and the one or more pads;
wherein the shoulder rest is a single unitary structure.

2. The shooting rest of claim 1, further comprising one or more spines proximal to the back wall.

3. The shooting rest of claim 1, wherein the one or more mounts are formed from a rigid material and the shoulder rest is formed from a resilient material that is less rigid than the rigid material.

4. A shooting rest comprising:
a frame having a first end and a second end;
a firearm support at the second end;
one or more mounts at the first end; and
a shoulder rest at the first end, the shoulder rest comprising:
a body comprising a front end, a rear end, and sides, the body attached to the one or more mounts;
an open portion at the front end for receiving a portion of a firearm, the open portion defined by one or more walls and a bottom, the open portion being open in a direction facing the firearm support;
one or more pads extending outward at the rear end; and
an open webbing portion having one or more lateral openings, the open webbing portion between at least one of the one or more walls and the one or more pads;
wherein the shoulder rest is a single unitary structure.

5. The shooting rest of claim 4, wherein the shoulder rest further comprises another open webbing portion having one or more lateral openings, the open webbing portion proximal to a back wall of the open portion.

6. The shooting rest of claim 4, further comprising one or more spines proximal to the back wall.

7. A method for providing a shooting rest comprising:
forming, from a single unitary material:
one or more cavities in a body between a front end, a rear end, and sides of the body;
an open area at the front end of the body, the open area defined by a back wall, one or more side walls, and a bottom, the one or more side walls and the bottom extending outward from the back wall;
one or more pads at the rear end of the body, the one or more pads extending outward at a rear end of the body; and
an open webbing portion having one or more lateral openings, the open webbing portion between the back wall and the one or more pads;
receiving one or more mounts in the one or more cavities, the one or more mounts attached to a frame of the shooting rest at a first end of the frame; and
attaching a firearm support at a second end of the frame, wherein the open area is open in a direction facing the firearm support.

8. The method of claim 7, further comprising forming, from the single unitary material, another open webbing portion having one or more lateral openings, the open webbing portion proximal to the back wall.

9. The method of claim 7, further comprising forming one or more spines in the body proximal to the back wall.

10. The method of claim 7, wherein the one or more mounts and the frame are formed from a rigid material and the single unitary material is formed from a resilient material that is less rigid than the rigid material.

* * * * *